US010479122B2

(12) United States Patent
Kritchman et al.

(10) Patent No.: US 10,479,122 B2
(45) Date of Patent: Nov. 19, 2019

(54) PRINTING HEAD NOZZLE EVALUATION

(75) Inventors: Eliahu M. Kritchman, Tel Aviv (IL); Timofey Shmal, Holon (IL)

(73) Assignee: XJET LTD., Rehovot (IL)

( * ) Notice: Subject to any disclaimer, the term of this patent is extended or adjusted under 35 U.S.C. 154(b) by 314 days.

(21) Appl. No.: 13/811,296

(22) PCT Filed: Jul. 19, 2011

(86) PCT No.: PCT/IL2011/000577

§ 371 (c)(1),
(2), (4) Date: Jan. 21, 2013

(87) PCT Pub. No.: WO2012/011104

PCT Pub. Date: Jan. 26, 2012

(65) Prior Publication Data

US 2013/0176355 A1 Jul. 11, 2013

Related U.S. Application Data

(60) Provisional application No. 61/366,739, filed on Jul. 22, 2010.

(51) Int. Cl.
*B41J 29/393* (2006.01)

(52) U.S. Cl.
CPC ..... *B41J 29/393* (2013.01)

(58) Field of Classification Search
CPC ..... B41J 29/393; B41J 2029/3935
USPC ..... 347/43
See application file for complete search history.

(56) References Cited

U.S. PATENT DOCUMENTS

| | | | |
|---|---|---|---|
| 3,451,791 | A | 6/1969 | Meadows |
| 4,847,636 | A | 7/1989 | Durbeck et al. |
| 5,136,515 | A | 8/1992 | Helinski |
| 5,151,377 | A | 9/1992 | Hanoka et al. |
| 5,640,183 | A | 6/1997 | Hackleman |
| 6,291,123 | B1 | 9/2001 | Ohno et al. |
| 6,305,769 | B1 | 10/2001 | Thayer et al. |
| 6,328,418 | B1 | 12/2001 | Yamada et al. |

(Continued)

FOREIGN PATENT DOCUMENTS

| | | |
|---|---|---|
| CN | 101125483 A | 6/2011 |
| DE | 4324647 | 1/2007 |

(Continued)

OTHER PUBLICATIONS

International Search Report for International Application No. PCT/IL2011/000577 dated Nov. 15, 2011.

(Continued)

*Primary Examiner* — Lamson D Nguyen
(74) *Attorney, Agent, or Firm* — Finnegan, Henderson, Farabow, Garrett & Dunner LLP

(57) ABSTRACT

A method for evaluating performance of a plurality of nozzles of a printing head includes repeatedly operating each of the nozzles to print test marks on a surface of a substrate, each of the test marks printed by that nozzle being printed at a different time. At least once during the repeated operation of each of the nozzles, at least some of the test marks are erased from the surface. The test marks that were printed by that nozzle are inspected for a feature that is indicative of the performance of that nozzle.

19 Claims, 4 Drawing Sheets

(56) References Cited

U.S. PATENT DOCUMENTS

| | | | | |
|---|---|---|---|---|
| 6,454,382 | B1 * | 9/2002 | Galentovski | B41J 29/38 347/14 |
| 6,471,352 | B2 | 10/2002 | Akahira | |
| 6,514,343 | B1 | 2/2003 | Motoda | |
| 6,536,853 | B2 | 3/2003 | Beauchamp et al. | |
| 6,824,245 | B2 | 11/2004 | Silverbrook et al. | |
| 7,037,448 | B2 | 5/2006 | Nagai et al. | |
| 7,184,069 | B2 * | 2/2007 | Yamamoto | B41M 7/0009 347/179 |
| 7,393,073 | B2 | 7/2008 | Zach | |
| 7,418,216 | B2 * | 8/2008 | Elliot | G03G 15/5041 399/49 |
| 7,479,297 | B2 | 1/2009 | Miura | |
| 7,494,607 | B2 | 2/2009 | Wang et al. | |
| 7,502,023 | B2 | 3/2009 | Zinniel et al. | |
| 7,506,960 | B2 | 3/2009 | Chikanawa et al. | |
| 7,513,595 | B2 | 4/2009 | Nakamura | |
| 7,718,092 | B2 | 5/2010 | Rose et al. | |
| 7,919,538 | B2 | 4/2011 | Vo et al. | |
| 8,319,808 | B2 * | 11/2012 | Sadowara | B41J 2/355 347/179 |
| 8,363,261 | B1 * | 1/2013 | Zimmerman | B41J 2/16585 347/14 |
| 9,004,667 | B2 * | 4/2015 | Taguchi | B41J 2/45 347/102 |
| 2002/0015855 | A1 | 2/2002 | Sajoto et al. | |
| 2002/0085056 | A1 | 7/2002 | Ylitalo | |
| 2003/0074611 | A1 * | 4/2003 | Nachumovsky | G11C 29/006 714/718 |
| 2004/4004189 | | 3/2004 | Yoneyama et al. | |
| 2004/0115339 | A1 | 6/2004 | Ito | |
| 2004/0151978 | A1 | 8/2004 | Huang | |
| 2004/0246294 | A1 | 12/2004 | Mitsuzawa | |
| 2005/0104241 | A1 | 5/2005 | Kritchman et al. | |
| 2005/0253879 | A1 | 11/2005 | Yamanobe | |
| 2006/0044331 | A1 | 3/2006 | Tsutsumi et al. | |
| 2006/0045962 | A1 | 3/2006 | Miura | |
| 2006/0132571 | A1 | 6/2006 | Baker | |
| 2006/0216043 | A1 | 9/2006 | Evans | |
| 2007/0063366 | A1 | 3/2007 | Cunningham et al. | |
| 2007/0070111 | A1 * | 3/2007 | Vladislav | B41J 2/2139 347/19 |
| 2007/0107773 | A1 | 5/2007 | Fork et al. | |
| 2007/0153035 | A1 | 7/2007 | Jung et al. | |
| 2007/0211105 | A1 | 9/2007 | Furukawa | |
| 2008/0024557 | A1 | 1/2008 | Moyhihan | |
| 2008/0158278 | A1 | 7/2008 | Inoue | |
| 2008/0314276 | A1 | 12/2008 | Gothait et al. | |
| 2009/0145479 | A1 | 6/2009 | Williams | |
| 2009/0161130 | A1 | 6/2009 | Mabuchi et al. | |
| 2009/0244153 | A1 * | 10/2009 | Miyamoto | B41J 2/2139 347/15 |
| 2009/0321123 | A1 | 12/2009 | Lochtman | |
| 2010/0040767 | A1 | 2/2010 | Uibel et al. | |
| 2010/0061925 | A1 | 3/2010 | Lee et al. | |
| 2011/0151665 | A1 | 6/2011 | Gothati et al. | |
| 2011/0227988 | A1 * | 9/2011 | Yamazaki | B41J 29/393 347/19 |
| 2011/0279544 | A1 | 11/2011 | Dovrat et al. | |
| 2011/0292153 | A1 * | 12/2011 | Sadowara | B41J 2/355 347/179 |
| 2012/0015152 | A1 | 1/2012 | Takahashi et al. | |
| 2012/0062640 | A1 | 3/2012 | Uraki et al. | |
| 2012/0081455 | A1 | 4/2012 | Kritchman et al. | |
| 2012/0308837 | A1 | 12/2012 | Schlechtriemen et al. | |
| 2013/0141491 | A1 | 6/2013 | Kritchman et al. | |
| 2013/0176355 | A1 | 7/2013 | Kritchman et al. | |
| 2013/0208048 | A1 | 8/2013 | Kritchman et al. | |
| 2014/0360762 | A1 | 12/2014 | Lee | |
| 2015/0255632 | A1 | 9/2015 | Kritchman et al. | |
| 2015/0298394 | A1 | 10/2015 | Sheinman | |
| 2016/0039207 | A1 | 2/2016 | Kritchman et al. | |
| 2016/0229128 | A1 | 8/2016 | Dayagi et al. | |
| 2016/0236372 | A1 | 8/2016 | Benichou et al. | |
| 2016/0243619 | A1 | 8/2016 | Gothait et al. | |

FOREIGN PATENT DOCUMENTS

| | | | |
|---|---|---|---|
| EP | 1 398 728 | 3/2004 | |
| EP | 1 918 026 | 5/2008 | |
| JP | 03-184852 | 8/1991 | |
| JP | 04-235054 | 8/1992 | |
| JP | H09-193404 | 7/1997 | |
| JP | 11-342598 | 12/1999 | |
| JP | H11-342598 | 12/1999 | |
| JP | 2003-133692 | 5/2003 | |
| JP | 2006/044176 | 2/2006 | |
| JP | 2007-152161 | 6/2006 | |
| JP | 2007-061784 | 3/2007 | |
| JP | 2008-124413 | 5/2008 | |
| JP | 2009/241534 | 10/2009 | |
| JP | 2010-069856 | 4/2010 | |
| JP | 2011-016301 | 1/2011 | |
| WO | WO 2006/081310 | 8/2006 | |
| WO | WO 2007/076424 | 7/2007 | |
| WO | WO 2008/084972 | 7/2008 | |
| WO | WO 2009/017648 | 2/2009 | |
| WO | WO 2009/029939 | 3/2009 | |
| WO | WO 2009141448 A1 * | 11/2009 | B41J 2/2135 |
| WO | WO 2014/068579 | 5/2014 | |

OTHER PUBLICATIONS

International Search Report dated Feb. 17, 2015 in International Application No. PCT/IB2014/065400 (6 pages).

International Search Report dated Jan. 11, 2015 in International Application No. PCT/IB2014/065401 (6 pages).

International Search Report dated Oct. 17, 2014 in International Application No. PCT/IB2014/065402 (7 pages).

Cappi B. et al. "Direct inkjet printing of Si3N4: Characterization of ink, green bodies and microstructure", 2008, Journal of the European Ceramic Society, vol. 28 pp. 2625-2628 (published on line: Apr. 28, 2008).

Mott M. et al."Microengineering of Ceramics by Direct Ink-Jet Printing" ,1999, JAm, Ceram. Soc., Vo/.82 ,No. 7, pp. 1653-1658 (Jul. 31, 1999) DOI: 10.1111/j.1151-2916.1999.tb0.

Ozkol E. et al. "Development of high solid content aqueous 3Y-TZP suspensions for direct inkjet printing using a thermal inkjet printer", 2009, Journal of the European Ceramic Society, vol. 29, pp. 403-409 (published on line: Aug. 13, 2008).

Song H. J. et al. "Formulation and Multilayer jet Printing of Ceramic inks", 1999, J. Am. I-3,13-17,27,28 Ceram, Soc., vol. 82 ,No. 12, pp. 3374-3380 (Dec. 31, 1999).

International Search Report dated Feb. 19, 2016 in International Application No. PCT/IL2013050453 (7 pages).

Ahn B. Y. et al., "Printed Origami Structures"—Published online: Apr. 15, 2010 (4 pages).

Hong E. et al. "Microstructure and Mechanical Properties of Reticulated Titanium Scrolls"—Published online: Aug. 29, 2011 (6 pages).

TriTrust Industrial, "Preparationof superfine TiH2 powder with high energy ball milling"—Published online: Oct. 9, 2014 (2 pages).

* cited by examiner

PRINTING HEAD NOZZLE EVALUATION

CROSS-REFERENCE TO RELATED APPLICATIONS

This application is a National Phase Application of PCT International Application No. PCT/IL2011/000577, entitled "PRINTING HEAD NOZZLE EVALUATION", International Filing Date Jul. 19, 2011, published on Jan. 26, 2012 as International Publication No. WO 2012/011104, which in turn claims priority from U.S. Provisional Patent Application No. 61/366,739, filed Jul. 22, 2010, both of which are incorporated herein by reference in their entirety.

FIELD OF THE INVENTION

The present invention relates to printing systems. More particularly, the present invention relates to evaluation of nozzles of a printing head.

BACKGROUND OF THE INVENTION

Techniques of inkjet printing that were originally developed for deposition of ink on substrates to created printed text or graphics have been applied to additional applications. As one example, inkjet printing techniques have been applied to depositing metallic conducting material on surface of semiconductor substrates. Thus, for example, inkjet printing techniques may be applied to deposit electrical connections on semiconductor-based electronic devices, such as photovoltaic cells for solar electrical power generation.

A printing head of an inkjet printer typically includes a large plurality of nozzles through which the printing fluid (e.g. ink) may be dispensed. The nozzles are typically arranged in the form of a one- or two-dimensional array. An array of nozzles typically includes rows or lines of aligned nozzles.

For at least some applications of inkjet printing techniques, a nozzle of the array may be expected to be aligned with other nozzles of the array. Thus, each nozzle used in the application may be expected to deposit printing fluid with a particular spatial relationship relative to printing fluid that is deposited by other nozzles used in the application. An example of such an application may include depositing a line of conducting material on a surface of a semiconductor. In order that the line of conduction material have a desired thickness, relative motion between a printing head and the substrate may be in a direction parallel to a row of nozzles of the array. During the course of the motion, a plurality of nozzles of the row may deposit conducting material in a synchronized manner on the surface. Due to the motion, the material that is deposited by each nozzle may be in the form of a printed line of conducting material. It is expected in this case that each of the nozzles of the row (except the first) deposits a line or a layer of conducting material on top of the previously deposited lines were deposited by the previous nozzles. Failure to do so consistently and accurately may reduce the quality of the deposited lines of conducting material.

It is an object of embodiments of the present invention to provide for evaluation of nozzles of a printing head so as to ensure that the printing heads deposits material as part of a printing application in a consistently aligned manner.

It is further object of embodiments of the present invention to provide for evaluation of the nozzles using a reusable substrate.

Other aims and advantages of the present invention will become apparent after reading the present invention and reviewing the accompanying drawings.

SUMMARY OF THE INVENTION

There is thus provided, in accordance with some embodiments of the present invention, a method for evaluating performance of a plurality of nozzles of a printing head, the method including: repeatedly operating each of the plurality of nozzles to print test marks on a surface of a substrate, each of the test marks printed by that nozzle being printed at a different time; at least once during the step of repeatedly operating each of the nozzles, erasing at least some of the test marks from the surface; and inspecting the test marks that were printed by that nozzle for a feature that is indicative of the performance of that nozzle.

Furthermore, in accordance with some embodiments of the present invention, inspecting the test marks includes acquiring an image of each of the test marks and inspecting the acquired image.

Furthermore, in accordance with some embodiments of the present invention, the method includes accepting a nozzle of the plurality of nozzles for inclusion in a group of nozzles of the printing head that are selected for use in a printing application if the evaluated performance conforms to a predetermined criterion.

Furthermore, in accordance with some embodiments of the present invention, erasing the test marks includes rubbing a wiper against the surface.

Furthermore, in accordance with some embodiments of the present invention, the method includes inserting a wiper foil between the wiper and the surface during rubbing the wiper against the surface.

Furthermore, in accordance with some embodiments of the present invention, the method includes heating the surface.

Furthermore, in accordance with some embodiments of the present invention, the substrate surface includes glass or a ceramic.

Furthermore, in accordance with some embodiments of the present invention, the feature includes a position of the test mark or a thickness of the test mark.

There is further provided, in accordance with some embodiments of the present invention, a method for evaluating stability of a plurality of nozzles of a printing head, the method including: repeatedly operating each of the plurality of nozzles to print test marks, each of the test marks printed by that nozzle being printed at a different time; and comparing the test marks that were printed by that nozzle to determine stability of that nozzle.

Furthermore, in accordance with some embodiments of the present invention, comparing the test marks includes: acquiring an image of each of the test marks that were printed by a nozzle one of the plurality of nozzles; and comparing the images to detect differences between the test marks indicative of lack of stability of that nozzle.

Furthermore, in accordance with some embodiments of the present invention, the method includes accepting a nozzle of the plurality of nozzles for inclusion in a group of nozzles of the printing head that are selected for use in a printing application if the determined stability conforms to a predetermined criterion.

Furthermore, in accordance with some embodiments of the present invention, the method includes erasing at least some of the test marks from the surface at least once during the step of repeatedly operating each of the nozzles.

Furthermore, in accordance with some embodiments of the present invention, comparing the test marks comprises comparing positions of the test marks or comparing thicknesses of the test marks.

There is further provided, in accordance with some embodiments of the present invention, a system for evaluating performance of a plurality of nozzles of a printing head, the system including: an imaging device for acquiring images of test marks that were printed on a substrate surface by each of the plurality of nozzles; a processor configured to detect features of the acquired images, the features being indicative of the performance of that nozzle; and an eraser device for erasing the test marks from the substrate surface.

Furthermore, in accordance with some embodiments of the present invention, the eraser device includes a wiper for erasing the test marks when the wiper is rubbed against the substrate surface.

Furthermore, in accordance with some embodiments of the present invention, the eraser device includes a dispenser for dispensing a wiper foil such that the wiper foil is inserted between the wiper and the substrate surface when the wiper is rubbed against the substrate surface.

Furthermore, in accordance with some embodiments of the present invention, the wiper foil includes paper.

Furthermore, in accordance with some embodiments of the present invention, the wiper includes a resilient material at least partially surrounded by an abrasive material.

Furthermore, in accordance with some embodiments of the present invention, the abrasive material includes plastic fibers.

Furthermore, in accordance with some embodiments of the present invention, the system includes a conveying device for conveying the substrate surface to one or more of the printing head, the imaging device, and the eraser device.

BRIEF DESCRIPTION OF THE DRAWINGS

In order to better understand the present invention, and appreciate its practical applications, the following Figures are provided and referenced hereafter. It should be noted that the Figures are given as examples only and in no way limit the scope of the invention. Like components are denoted by like reference numerals.

DETAILED DESCRIPTION OF EMBODIMENTS

Figure 1:
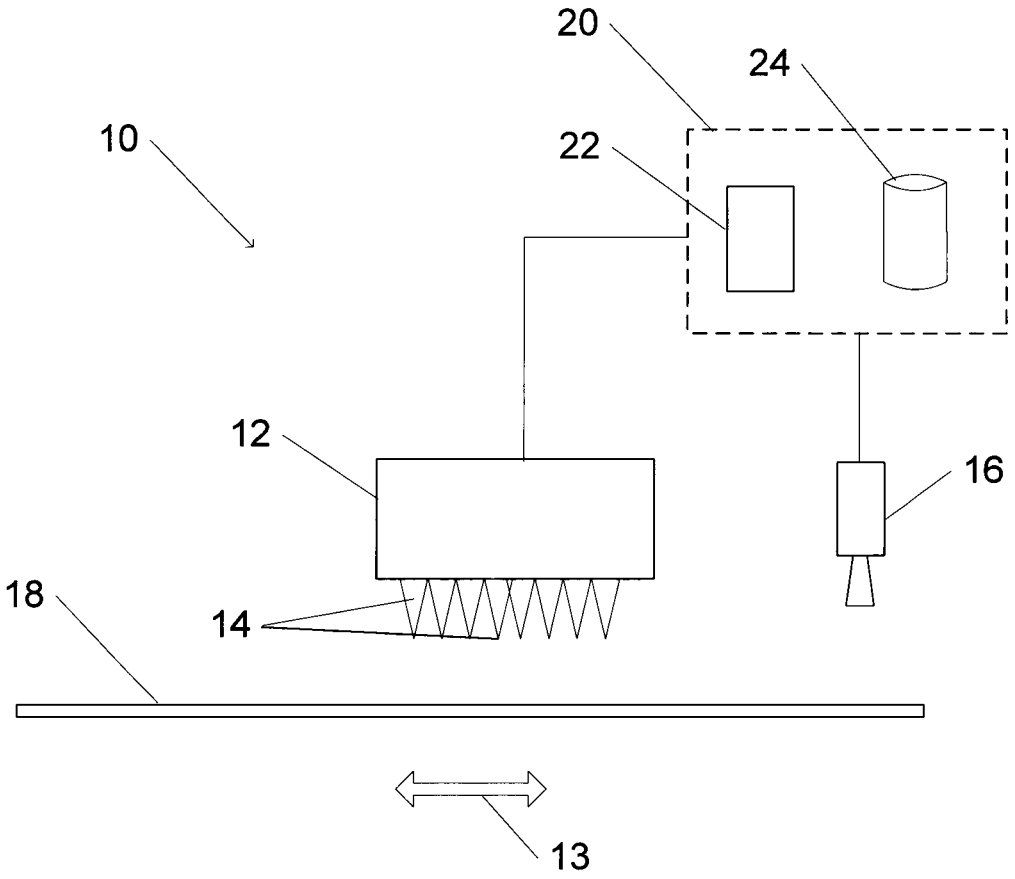
FIG. 1 is a schematic diagram of a system for printing head nozzle stability evaluation, in accordance with an embodiment of the present invention.

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

Embodiments of the invention may include an article such as a computer or processor readable medium, or a computer or processor storage medium, such as for example a memory, a disk drive, or a USB flash memory, encoding, including or storing instructions, e.g., computer-executable instructions, which when executed by a processor or controller, carry out methods disclosed herein.

In accordance with embodiments of the present invention, the quality of each nozzle of a printing head is evaluated. As a result of the evaluation, a nozzle may be accepted for inclusion in a group of nozzles that are selected for use in a printing application. For example, evaluation of stability of a nozzle may consist of comparing test marks that were repeatedly printed by each nozzle at different times (e.g. periodically) by depositing a printing fluid on a surface of a substrate. The test marks that were printed by a single nozzle at different times may be compared with one another in order to detect any inconsistent, irregular, or unstable behavior when printing with that nozzle. In addition, test marks that were printed by different nozzles of the head may be compared to one another. If analysis of the test marks shows that the test marks that were printed by one of the nozzles conform to predetermined stability criteria (as well as any other quality criteria), that nozzle may be accepted for inclusion in the group of selected nozzles. Conformity with the criteria typically indicates that the marks printed by a single nozzle are consistent with one another (e.g. indicating that the nozzle prints consistently and stably), and that they conform to marks that were printed by other nozzles (e.g. indicating proper alignment and an acceptable rate of dispensing of printing fluid).

Criteria for inclusion into the group of selected nozzles may include a value of a property of a nozzle that is measurable via printed test marks. For example, nozzle that consistently prints test marks that are laterally displaced from test marks that were printed by other nozzles of a printing head, or that are laterally displaced from a desired lateral position for the test marks, may be rejected from inclusion in the group of selected nozzles.

Evaluating the stability of a nozzle printing may include comparison with recorded results of past tests of the nozzle (which may be referred to as the history of the nozzle performance). Evaluation may include a weighting factor that assigns varying importance or relevance to tests that were performed at different times. For example, results of a test that was performed recently may be assigned a greater importance than results of a previous test that was performed less recently.

Typically, evaluation of the test marks includes acquiring and analyzing images of the test marks by an imaging device (e.g. camera, video camera, or scanner). Lack of stability may be indicated by differences between images of test marks that were printed by a single nozzle at different times.

In accordance with embodiments of the present invention, evaluating a nozzle may include printing test marks on a reusable substrate. Test marks may be removed or erased (to be understood as referring to any type of removal of the test marks) prior to reuse of the substrate. For example, the test marks may be erased following inspection or imaging of the test marks. Alternatively, the test marks may be erased when a surface of the substrate has been covered with previously printed marks to an extent that prevents or makes difficult printing of additional and legible test marks. Alternatively, the test marks may be erased periodically or in accordance with predetermined criteria.

Nozzle evaluation in accordance with embodiments of the present invention may enable a printer or printing system to select a one or more groups of nozzles from among nozzles of a printing head. Selection may be implemented as a result of repeatedly printing onto a substrate and automatically inspecting a pattern of test marks. The automatic inspection may identify one or more groups of nozzles within which the nozzles of the group consistently print marks that are aligned with one another and that are similar to one another (e.g. with regard to the amount of printing fluid that was deposited to form each mark). One or more of the identified groups of nozzles may be selected for a use during a printing operation. During the printing operation, the selected group of nozzles may be operated to deposit a printing fluid (e.g. an ink or a metallic conducting material) in a coordinated manner on a substrate.

For example, nozzle stability evaluation in accordance with an embodiment of the present invention may result in selection of a group of nozzles (e.g. 10 nozzles) from a row of nozzles of a printing head (e.g. that includes 256 nozzles having a separation distance of about 70 μm between nozzles). The nozzles of the selected group are identified as capable of consistently depositing a repeatable amount of conducting material along a single straight line on a substrate. A printing application for such a selected group may include operating a the nozzles of the selected group to deposit a single multi-layered line of conducting material on a semiconducting substrate, typically during a single pass of a printing head over a substrate.

For example, a printing device may generate a linear relative motion between the printing head and the substrate (e.g. by linear motion of the printing head, of the substrate, or of both). Typically, the linear motion is in a direction that is parallel to the row of nozzles. During the linear relative motion, a specific location on the surface of the substrate may be sequentially found opposite each of the nozzles of the selected group. All or some of the nozzles of the selected group may be operated concurrently or sequentially (or both at different times) such that each nozzle deposits conducting material at the location on the substrate surface that is currently opposite that nozzle. Thus, after a first nozzle of the selected group deposits conducting material at a particular location on the substrate, a second nozzle subsequently deposits more conducting material on top of the conducting material that was deposited by the first nozzle. Thus, a second layer of conducting material is deposited atop the first. Thus, the number of nozzles that are operated during the printing application need not exceed the number of layers of conducting material that is to be deposited on each printed line (e.g. 10).

Since, typically, each deposited layer may be solidified prior to deposition of a subsequent layer, proper alignment of the nozzles may ensure that the width of the multiply-layered line is approximately equal to the width of a single layer. In this example in particular, the nozzle jetting directionality (the lateral direction in which ink is dispensed) may be of particular importance so as not to widen the width of the line unnecessarily. In this case in particular, each nozzle should deposit its layer as nearly as possible on top of previously deposited layers.

Evaluation of the nozzles of the printing head includes performing a printing operation in which each nozzle, or each nozzle of a subset of the nozzles of the printing head (e.g. a single row of an array of nozzles), is operated to print on a test substrate in a predetermined order. For example, during linear relative motion between the printing head and the substrate, each nozzle may sequentially print a test mark in the form of an elongated line segment (or dash). An imaging system may then acquire an image (or images) of the pattern of the printed test marks. Analysis of the marks may identify those nozzles whose performance is significantly deviates from the performance of the other nozzles. Such deviations may include printing a test mark that is laterally or longitudinally displaced relative to the positions of test marks that were printed by the other nozzles (e.g. indicating a nozzle that is aimed differently from the other nozzles), or a test mark that is thicker or thinner than the other test marks (e.g. indicating a nozzle that dispenses material at a rate different from the dispensing rate of the other nozzles). The acquired image may be stored for later comparison with subsequent test results.

The printing operation may be repeated at predetermined intervals. For example, a pattern of test marks may be printed at a later time at another location on the same substrate surface, or on a different substrate surface. As another example, test marks may be erased or otherwise removed from a substrate surface. Another set of test marks may then be printed on the same locations on the test substrate. Images of the subsequently printed patterns of test marks may then be acquired and analyzed. Analysis of the subsequently acquired test images may include comparison of the newly acquired results with stored results of previously acquired test images. A significant change from image to image of the appearance of a test mark that was printed by one of the nozzles may indicate that the nozzle prints with variable, inconsistent, unstable, or erratic behavior.

Typically, a number of nozzles required for an application (e.g. 10 as in the aforementioned example) may be selected for inclusion in a selected group of nozzles. The nozzles for the selected group may be selected from among those nozzles whose behavior (as indicated by analysis of images of the test patterns) meets predetermined criteria. The criteria may include consistency over time and that the positions and quality of the marks fall within predetermined limits.

The number of acceptable nozzles that meet predetermined criteria may be greater than the number of required nozzles. If the number of acceptable nozzles is greater than the number of required nozzles, then the nozzles selected for the group may be those nozzles that performed best during nozzle testing. For example, a score may be assigned to each nozzle. The score may be based on analysis of the test marks that were printed by that nozzle. The score may be calculated on the basis of a formula that is based on the relative importance of various properties of the marks (e.g. location with respect to an expected location, properties such as thinness or thickness of the printed mark, consistency) with respect to a particular printing application. Alternatively, nozzles for inclusion in the group may be selected from among the acceptable nozzles on the basis of their spacing or other criteria not related to the performance of the nozzle during nozzle performance testing. Alternatively, nozzles may be selected randomly from among the acceptable nozzles for inclusion in the group. Alternatively, nozzles may be selected from among the acceptable nozzles on a rotating basis for inclusion in the group (e.g. one set of nozzles is selected for operation during one printing job, and a different set, which may partially overlap the first set, may be select for a different printing job).

If the number of acceptable nozzles is less than the number of required nozzles, the printing head may be disqualified for one or more applications. Alternatively, e.g. for an application without stringent requirements, requirements may be relaxed in order to include a required number of the nozzles in the group.

FIG. 1 is a schematic diagram of a system for printing head nozzle stability evaluation, in accordance with an embodiment of the present invention. Printing head nozzle stability evaluation system 10 includes a printing head 12, an imaging device 16, and a controller 20.

Printing head 12 includes nozzles 14 for dispensing a printing fluid (e.g. ink or conducting material). The dispensed printing fluid may be deposited on a substrate 18. While printing head 12 deposits printing fluid on substrate 18, substrate 18 and printing head 12 are moved relative to one another. Typically, substrate 18 may be moved in past printing head 12.

Nozzles 14 of printing head 12 deposit printing fluid so as to print a test mark on substrate 18. The printing is configured in such a manner that printing fluid that is deposited by one of nozzles 14 is distinguishable from printing fluid that is deposited by another. For example, each nozzle 14 of a row of nozzles may be operated one at a time. Each nozzle 14 sequentially deposits a test mark on substrate 18 as substrate 18 is moved past printing head 12. Thus, a series of test marks may be printed on substrate 18. If the order in which nozzles 14 were operated is known, the nozzle 14 that printed each test mark may be determined by the position of that test mark within the series. For example, the marks may be counted starting with a known reference test mark at one end of the series. Alternatively or in addition, substrate 18 may be marked with one or more fiducial marks or lines. Each test mark may be printed on substrate 18 at a (nominally, subject to printing behavior of nozzles 14) known position relative to the fiducial marks.

Figure 2:
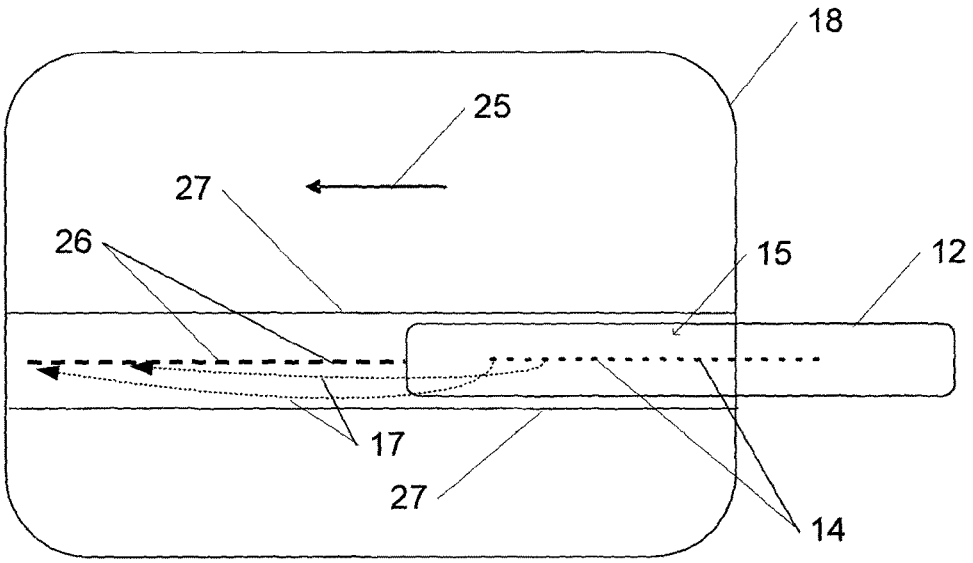
FIG. 2 schematically illustrates depositing test marks for printing head nozzle stability evaluation in accordance with an embodiment of the present invention.

FIG. 2 schematically illustrates depositing test marks for printing head nozzle stability evaluation in accordance with an embodiment of the present invention.

Nozzles 14 of printing head 12 are arranged in the form of row 15. Each nozzle 14 of row 15, in turn, deposits a test mark 26 on substrate 18. Examples of particular marks 26 that were printed on substrate 18 by particular nozzles 14 are indicated by lines 17. For example, substrate 18 may include a surface of glass, a ceramic, or of a semiconductor material. During printing of test marks 26 on substrate 18, substrate 18 is moved linearly (in a single direction and at constant velocity) in the direction indicated by arrow 25 relative to printing head 12. The direction indicated by arrow 25 is substantially parallel to orientation of row 15. The linear relative motion may be realized by linear motion of substrate 18, of printing head 12, or of both. Due to the relative linear motion, each mark 26 may be printed on substrate 18 in the form of an elongated mark (e.g. in the form of a dash or hyphen).

For example, in a printing head 12 that includes 256 nozzles 14 arranged in a row 15, 256 test marks 26 may be printed in a nominally linear arrangement on substrate 18. For example, if substrate 18 is about 150 mm long, each of the test marks 26 may be no longer than about half a millimeter long.

Substrate 18 may be marked with an additional set of test marks 26 one or more additional times. For example, controller 20 may be configured to move substrate 18 and printing head 12 past one another two or more times. For example, a substrate transport device or system may be configured to return substrate 18 to printing head 12 for printing of an additional set of test marks 26. Additional sets of test marks 26 may be printed automatically at regular predetermined intervals (e.g. once per minute), at random intervals, or as initiated by a human operator of printing head nozzle stability evaluation system 10. For example, each time that substrate 18 is returned to printing head 12 for printing of an additional set of test marks 26, substrate 18 may be displaced laterally or otherwise such that the additional set of test marks 26 is printed on a different part of the surface of substrate 18 that were previous sets of test marks 26. Thus, each set of test marks 26 may be distinguishable from previously printed sets.

Substrate 18 may be marked with one or more fiducial marks (or sets of fiducial marks), such as fiducial lines 27. Fiducial lines 27 may provide a spatial reference for depositing or evaluating test marks 26.

Referring again to FIG. 1, after having been printed with test marks, substrate 18 may be transported or conveyed by substrate transport device 13 to imaging device 16. Substrate transport device 13, schematically represented by a two-headed arrow, may represent one or more substrate conveyance devices known in the art, or a combination or series of such devices. Such conveyance devices may include, for example, conveyor belts, robot arms, fluid (liquid or gas) based flow substrate conveyance systems, or mobile platforms.

Imaging device 16 may include one or more video or still cameras, scanners, or any other devices that are capable of acquiring an image of test marks 26 on substrate 18. Component devices of imaging device 16 may include imaging devices that are sensitive to differing spectral ranges. When substrate 18 is conveyed to imaging device 16, imaging device 16 may be operated so as to acquire one or more images of the test marks on substrate 18. The resolution of imaging device 16 may be sufficient to distinguish individual test marks 26 from one another and to resolve any characteristics of a test mark 26 that may be relevant to selection of its associated nozzle 14.

In the event that multiple sets of test marks are printed on substrate 18, substrate 18 may be transported to imaging device 16 after printing of each set of test marks, and prior to printing of another set. Alternatively, substrate 18 may be transported to imaging device only after two or more sets of test marks had been printed on substrate 18.

Controller 20 includes a processor 22 and data storage device 24. Controller 20 may represent two or more separate devices. The separate devices may perform related or overlapping functions, or may be independent of one another. Controller 20 may communicate with, receive data or signals from, and control operation of printing head 12, imaging device 16, and any other device or system (e.g. a conveyor or transport device) that is associated with, or is integral to, printing head nozzle stability evaluation system 10.

Processor 22 may represent one or more processing devices. The processing devices may be associated with a computer that communicates with printing head nozzle stability evaluation system 10, with printing head 12 (or with a printer or printing device of which the processor is a component), or with imaging device 16. Processor 22 may generate instructions for controlling operation of printing head 12 and imaging device 16. Processor 22 may be configured to analyze image data that is acquired by imaging device 16. For example, processor 22 may be configured to compare images of test marks 26 that were printed at different times.

Data storage device 24 may represent collectively one or more volatile or non-volatile, fixed or removable, data storage or memory devices. Data storage device may be configured to store programmed instructions for controlling operation of printing head 12 and imaging device 16, and for analysis of image or other data that is acquired by imaging device 16. Data storage device may be configured to store image data that is acquired by imaging device 16.

Image data that is acquired by imaging device 1 may be analyzed by processor 22 of controller 20. As a result of the analysis, some of nozzles 14 may be selected for inclusion in a group of selected nozzles. For example, analysis may include distinguishing images of printed test marks from the remainder of an acquired image, and calculating characterizing values (e.g. position, orientation, length, width or thickness, uniformity) that at least partially characterize each test mark. In the event that multiple sets of test marks were printed on a single wafer, analysis may also include distinguishing sets of test marks from one another. Each image of a test mark may be compared with an image of previously or subsequently printed test mark in order to determine a consistency or stability of the characterizing values over time.

After selection of a group of selected nozzles, controller 20 or another printer controller may operate printing head 12 to deposit or print a pattern on a substrate. The controller controls operation of nozzles 14 to dispense a printing fluid so as to deposit the desired pattern. As a result of the selection, the controller may limit dispensing printing fluid to those nozzles that were included in the group of selected nozzles.

Figure 3:
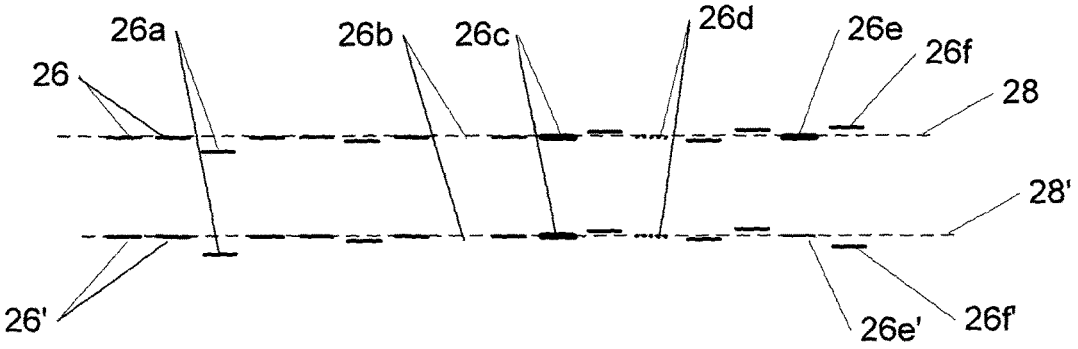
FIG. 3 schematically indicates printing head nozzle stability evaluation criteria in accordance with an embodiment of the present invention.

FIG. 3 schematically indicates printing head nozzle stability evaluation criteria in accordance with an embodiment of the present invention.

Test marks 26 represent an image of marks that were printed by nozzles of a printing head during linear motion between a printing head and a substrate. Test marks 26' represent an image of marks that were printed by the same nozzles of the same printing head and in the same manner, but at another time. For example, test marks 26 may have been printed at one position on a substrate, while test marks 26' were printed at a laterally displaced position on the same substrate, e.g. as shown in FIG. 3. Alternatively, test marks 26 and 26', as shown in FIG. 3 may represent a juxtaposition for illustrative purposes of two sets of marks that were printed separately. For example, test marks 26' may have been printed at a linearly or otherwise displaced position on the same substrate on which test marks 26 were printed, on a separate substrate, or on the same substrate after test marks 26 were erased or otherwise removed from the substrate.

Test marks 26 and 26' may be analyzed. The analysis may indicate whether or not a nozzle that printed a particular test mark 26 and its corresponding test mark 26' is to be included in the group of selected nozzles.

Analysis of test marks 26 and 26' typically includes analysis of the relative positions of test marks 26 and 26'. Line 28 is a representative imaginary line that represents a nominal position and orientation of test marks 26. For example, line 28 may represent a linear fit (e.g. a least squares or other fit) of a straight line to test marks 26. Similarly, line 28' represents a nominal position and orientation of test marks 26'.

Alternatively, lines 28 and 28' may represent a fiducial line or a position relative to a fiducial line that is provided (e.g. etched) on the substrate surface. For example, test marks 26 and 26' may be printed within an elongated region of a substrate. The elongated region may be demarcated on the substrate surface by parallel lines (e.g. fiducial lines 27 in FIG. 2). Test marks 26 and 26' are nominally printed along an imaginary center line that is midway between the demarcating lines. (The center line may typically not be actually visible so as to not interfere with detection and analysis of test marks 26 or 26'.) In this case, lines 28 and 28' may represent the imaginary center line of the elongated region.

If a lateral distance between one of test marks 26 and line 28 exceeds a predetermined lateral distance, or if a lateral distance between one of test marks 26' and line 28' exceeds the predetermined lateral distance, it may indicate that the nozzle that printed the mark does not consistently dispense printing fluid in the same relative lateral direction as do other nozzles of the row. The associated nozzle may then be excluded from selection for inclusion within the group of selected nozzles.

For example, outlying test marks **26*a* are shown as more laterally distant from line 28 and line 28' than others of test marks 26 and test marks 26'**, respectively.

Analysis of test marks 26 and 26' may include analysis of the size or visibility of test marks 26 and 26'. The appearance (e.g. width or thickness, or optical heaviness as characterized by a relative color or gray level of the image of the mark relative to the image background) of a test mark 26 or 26' may be different from the appearance of other test marks 26 or 26'. For example, if an imaging device that is associated with the nozzle selection system has sufficient resolution to resolve a width of a test mark 26 or 26', the width (e.g. an average or other characteristic value of the width) may be used to characterize the appearance of test mark 26 or 26'. Alternatively or in addition, the appearance of test mark 26 or 26' may be characterized by an optical heaviness of test mark 26 or 26'. Such a difference in appearance may indicate that the nozzle with the differently appearing mark does not consistently dispense ink at the same rate as other nozzles of the row. Therefore, that associated nozzle may be excluded from inclusion in the group of selected nozzles.

For example, invisible test marks **26*b* are shown completely absent. This may indicate that the corresponding nozzle does not dispense printing fluid at all (or very weakly). Heavy test marks 26*c* are shown as thicker than others of test marks 26 and 26'. This may indicate that the corresponding nozzle dispenses printing fluid at a greater rate than other nozzles of the row. Thin test marks 26*d* are shown as thinner than others of test marks 26 and 26'. This may indicate that the corresponding nozzle dispenses printing fluid at a lower rate than other nozzles of the row. Thus, the nozzles that correspond to any of invisible test marks 26*b*, heavy test marks 26*c*, or thin test marks 26*d*** may be excluded from inclusion in the group of selected nozzles.

Analysis of test marks 26 and 26' may include analysis of the changes in the position or appearance between a test mark 26 and the test mark 26' that was printed by the same nozzle. If the appearance (e.g. thickness or heaviness) or position of a test mark 26 is different from that of its corresponding test mark 26', it may indicate that the associated nozzle does operate in a stable or consistent manner. For example, it may indicate that the nozzle dispenses printing fluid at an unstable or variable rate, or that it dispenses printing fluid in a direction that is unstable or variable. Therefore, that associated nozzle may be excluded from inclusion in the group of selected nozzles.

For example, the appearance of first test mark **26*e* is different (heavier) than the appearance of corresponding second test mark 26*e*'. This may indicate that the nozzle that printed first test mark 26*e* and second test mark 26*e*'** is unstable with regard to the quantity (or rate of deposition) of printing fluid that is deposited during printing. Therefore, that nozzle may be excluded from inclusion in the group of selected nozzles.

As another example, the lateral position of first test mark 26*f* relative to line 28 is different (opposite and greater) than the lateral position of corresponding second test mark 26*f* relative to line 28'. This difference in relative lateral position may indicate that the nozzle that printed first test mark 26*f* and second test mark 26*f* is unstable with regard to a lateral direction in which printing fluid is dispensed during printing. Therefore, that nozzle may be excluded from inclusion in the group of selected nozzles.

A test substrate on whose surface test marks 26 and 26' are printed may be selected so as to facilitate printing and analysis of test marks 26 and 26'. Thus, the test substrate may include, for example, a dummy (e.g. with no circuit) silicon wafer, a glass or ceramic wafer or slide, or an appropriately shaped piece of paper or cardboard. Additional considerations may further influence selection of a test substrate. For example, using a dummy silicon wafer in a disposable manner (e.g. discarding the dummy silicon wafer after its surface has been filled with printed test marks) may be more expensive than other alternatives. However, use of an inexpensive disposable test substrate (e.g. paper or cardboard) that differs in its properties (e.g. density, thickness, or weight) from a substrate for which a printing system is designed (e.g. a silicon wafer) may introduce alignment or handling problems. One solution, in accordance with an embodiment of the present invention, is to provide a reusable test substrate (e.g. with a glass or ceramic surface) whose relevant properties (e.g. dimensions and weight) are similar to those of a substrate for which the system is designed (e.g. silicon wafer).

Nozzle selection in accordance with an embodiment of the present invention may include depositing printing fluid on a reusable substrate. A nozzle section setup or system may include a device for erasing or otherwise removing deposited printing fluid from the substrate prior to reuse.

Figure 4A:
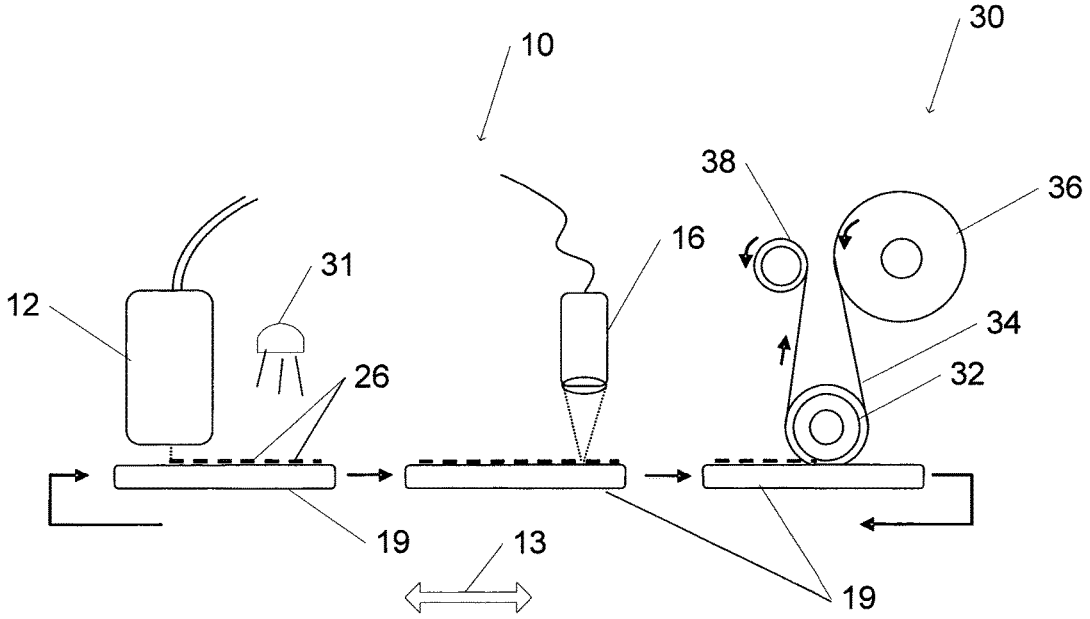
FIG. 4A schematically illustrates printing head nozzle stability evaluation using a reusable substrate, in accordance with an embodiment of the present invention.

FIG. 4A schematically illustrates printing head nozzle stability evaluation using a reusable substrate, in accordance with an embodiment of the present invention.

A system of nozzle selection using a reusable substrate may include printing head nozzle stability evaluation system 10 with mark eraser device 30. A reusable substrate 19 (e.g. a flat glass or ceramic plate) may be transported or conveyed to printing head 12. Printing head 12 may deposit a set of test marks 26 on reusable substrate 19.

Additional sets of test marks 26 may be printed on reusable substrate 19 at later times. After one or more sets of test marks 26 have been printed on reusable substrate 19, reusable substrate 19 may be transported to imaging device 16. Imaging device may acquire one or more images of test marks 26. The acquired images, or a characterization of test marks 26, may be stored for analysis of test marks 26.

Reusable substrate 19 may be reused periodically. Prior to reuse, reusable substrate 19 may be conveyed to mark eraser device 30. Mark eraser device 30 may be operated to remove all or sum of printed test marks 26 from a surface of reusable substrate 19. For example, a controller that controls printing head 12 or imaging device 16, or a separate controller, may control operation of mark eraser device 30.

Mark eraser device 30 may be operated to remove test marks 26 from reusable substrate 19 after each set of test marks is imaged by imaging device 16. Alternatively, mark eraser device 30 may be operated to remove test marks 26 from reusable substrate 19 when a surface of reusable substrate 19 has been filled with test marks 26. Alternatively or in addition, mark eraser device 30 may be operated to remove test marks 26 from reusable substrate 19 at predetermined intervals, as indicated by a human operator, or in accordance with other predetermined criteria.

Mark eraser device 30 may be configured to remove test marks 26 from reusable substrate 19 by applying mechanical abrasion, rubbing, or scraping to reusable substrate 19. Reusable substrate 19 may be constructed out of a material with a surface that is sufficiently hard that the surface of reusable substrate 19 is not detectibly scratched or otherwise damaged by the abrasion. For example, reusable substrate 19 may include a glass or ceramic surface.

One or more surfaces of reusable substrate 19 may include lines or other markings (e.g. fiducial lines or markings) that are not readily erasable by mark eraser device 30. For example, the non-erasable markings may have been formed by an etching or scratching process, may be incorporated into or internal to reusable substrate 19, or may have been formed by application of a non-erasable or permanent ink, dye, or paint.

One or more techniques may be applied in order to ensure that printing fluid that is deposited on a surface of reusable substrate 19 to form test marks 26 is solidified. Such solidification may ensure that ink that is deposited on the reusable substrate 19 to form test marks 26 remains in position until solidifying (e.g. so as to inhibit spreading, smearing, or blurring of test marks 26). Solidification may also facilitate erasing of test marks 26 by eraser device 30. Such solidification techniques, represented schematically by heating device 31, may include, for example, heating the substrate or applying electromagnetic radiation to the deposited printing fluid. For example, reusable substrate 19 may be preheated (e.g. to a temperature of about 150° C. to 230° C.) prior to printing on reusable substrate 19 by printing head 12. For example, reusable substrate 19 may be held by to a heated metal surface or chuck by applying a vacuum.

Alternatively or in addition to abrasion, a mark eraser device may apply one or more other techniques for loosening or removing test marks 26 from a surface of reusable substrate 19. Such techniques may include, for example, applying sonic or ultrasonic waves, mechanical motion (e.g. vibration or shaking), fluid (liquid or gas) motion, radiation (e.g. laser light), heat, or chemical agents.

Mark eraser device 30 includes wiper 32. Wiper 32 may be operated to rub against a surface of reusable substrate 19. For example, wiper 32 may be pressed against reusable substrate 19 during relative motion between wiper 32 and reusable substrate 19. For example, wiper 32 may have a circular cross section (as shown in FIG. 4A) and may be rolled while in contact with a surface of reusable substrate 19. As another example, wiper 32 may pressed against reusable substrate 19 as reusable substrate 19 is conveyed past wiper 32. As another example, wiper 32 may be rubbed or pressed with a linear motion against reusable substrate 19.

Wiper 32 may be provided with an outer surface that is designed to remove, or to facilitate removal of, printed test marks 26 from reusable substrate 19 when rubbed against reusable substrate 19. For example, the outer surface of wiper 32 may be abrasive. Such abrasiveness may facilitate scraping test marks 26 off of reusable substrate 19 when wiper 32 is rubbed against reusable substrate 19.

Typically, at least a portion of the outer surface of wiper 32 may be provided by a material. For example, the covering material may be such as to collect particles of test marks 26 after test marks 26 are erased. The covering material may thus preserve the cleanliness of, and increase the useful lifetime of, wiper 32. For example, the covering material may include a removable sheet or foil of a material, wiper foil 34. For example, wiper foil 34 may include a material such as a thin paper (e.g. tissue or filter paper) that is thin enough to enable an abrasive outer surface of wiper 32 to be felt through wiper foil 34.

Mark eraser device 30 may be configured to continually provide wiper foil 34 for covering or wrapping an outer surface of wiper 32. For example, mark eraser device 30 may include foil dispenser 36 for providing new (or clean) wiper foil 34. For example, foil dispenser 36 may be in the form of a roll of foil that is rotatable in order to dispense wiper foil 34. Alternatively, foil dispenser 36 may dispense wiper foil 34 from a folded stack or similar configuration.

Wiper foil 34 wraps at least partially around wiper 32 such that wiper foil 34 is positioned between wiper 32 and reusable substrate 19 during erasing. Thus, motion of wiper 32 may rub wiper foil 34 against reusable substrate 19 so as to remove test marks 26. After use, a used portion of wiper foil 34 may be taken up by foil take-up 38 (e.g. in the form of a roller around which a used portion of wiper foil 34 may be wrapped). Foil that is taken up by foil take-up 38 may be disposed of as desired.

Foil dispenser 36 and foil take-up 38 may advance wiper foil 34 continuously during operation of mark eraser device 30. Alternatively, foil dispenser 36 and foil take-up 38 may advance wiper foil 34 periodically or as needed (e.g. when the portion of wiper foil 34 that covers wiper 32 has become dirty, torn, or otherwise in need of replacing).

Alternatively, a foil or other surface for wrapping part or all of wiper 32 may be wrapped around wiper 32, or another wiping surface, until replaced. For example, a wiping foil may be replaced manually as needed, or by an automatically operated dispenser or wrapping mechanism.

Printing head nozzle stability evaluation system 10 may include substrate transport device 13, schematically represented by a two-headed arrow. Substrate transport device 13 may be configured, for example, to convey reusable substrate 19 from printing head 12 to imaging device 16, from imaging device 16 to mark eraser device 30, and back from mark eraser device 30 to printing head 12. This series of conveying by transport device 13 may be repeated periodically so as to enable repeated printing and imaging of a plurality of sets of test marks 26 at different times.

A wiper may be constructed so as to facilitate remove of test marks from the erasable substrate.

Figure 4B:
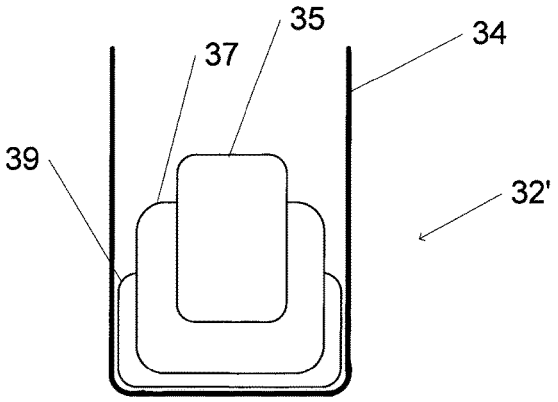
FIG. 4B schematically illustrates a structure of a wiper, in accordance with an embodiment of the present invention.

FIG. 4B schematically illustrates a structure of a wiper, in accordance with an embodiment of the present invention.

Wiper 32' represents wiping element of a mark eraser device, such as mark eraser device 30 (FIG. 4A). Although the construction of wiper 32' is shown with flat sides (e.g. as would be suitable for use a linear rubbing motion), the structure of a cylindrical or circular wiper, such as wiper 32 (FIG. 4A) may include similar components arranged in a concentric manner.

Wiper 32' may include a core 35. For example, core 35 may include a metallic or other hard material. Core 35 may be partially or fully surrounded by resilient element 37. For example, resilient element 37 may include rubber or a resilient polymeric material. Resilient element 37 may be partially or fully surrounded by abrasive element 39. Abrasive element 39 may present a rough, embossed, or ridged outer surface. For example, abrasive element 39 may include a rough or fibrous material, e.g. similar to material that is found in plastic fiber cleaning pads. Abrasive element 39 may be partially or fully surrounded by a replaceable wiper material, such as wiper foil 34.

Figure 5:
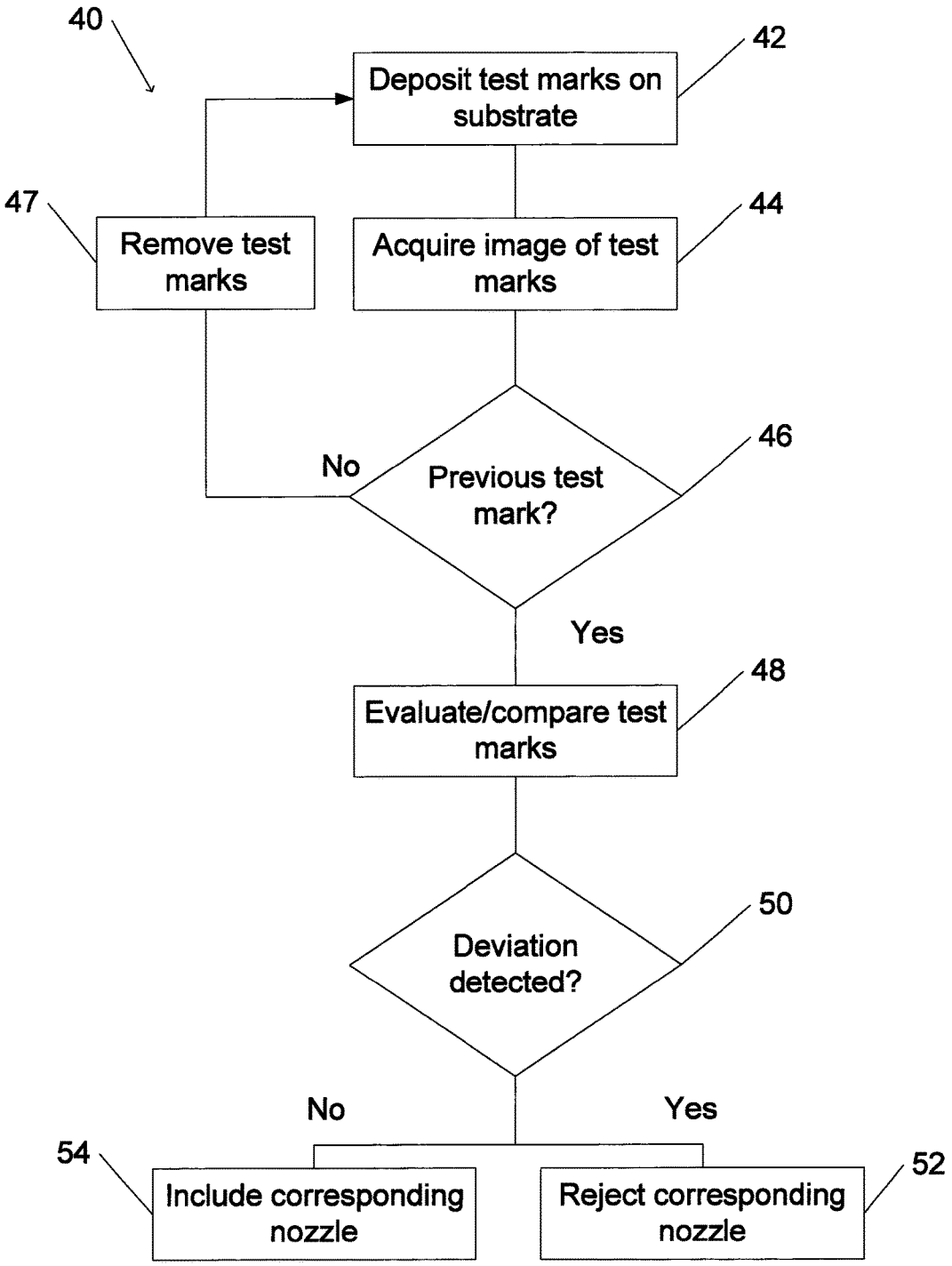
FIG. 5 is a flowchart of a printing head nozzle stability evaluation method in accordance with an embodiment of the present invention.

FIG. 5 is a flowchart of a printing head nozzle stability evaluation method in accordance with an embodiment of the present invention.

Nozzle selection method 40 includes depositing or printing a set of test marks on a surface of a substrate (step 42). For example, the substrate may be a reusable substrate or may be intended for a single use.

An image of the printed set of test marks may be acquired (step 44). The image may be saved or stored as acquired (or after application of one or more image processing techniques. Alternatively, the image may be analyzed in order to extract parameters or characterizing values that characterize the test marks in the image. In this case, the characterizing values may be stored.

If no previous images of sets of test marks were acquired (step 48), or if the number of previously imaged sets is insufficient for analysis, more sets of test marks may be printed and their images acquired (returning to step 42).

If the substrate is reusable, previously printed test marks may be removed from the substrate prior to depositing more test marks (step 47). Otherwise, the additional test marks may be printed on a different substrate or on another part of the same substrate (and step 47 is not performed).

If a sufficient number of sets of test marks were previously printed and imaged (and analyzed), the images of test marks (or their characterizing values) may be compared (step 48). For example, the characterizing values that characterize each mark may be compared to an average (or other typical) value of that characterizing value for corresponding test marks in each of the sets. Alternatively or in addition, a typifying value of the variation in the appearance of corresponding test marks over time (e.g. a standard deviation or variance of a characterizing value of a test mark in all of the sets) may be calculated.

If analysis of the test marks indicates an unacceptable (e.g. in accordance with predetermined criteria) degree of deviation (from other test marks or from a standard) or variation for one or more marks (step 50), the nozzles that printed those marks are rejected from inclusion in a group of selected nozzles (step 52). For example, a nozzle may be rejected due to lack of stability as evidenced by variation. A nozzle may be rejected the test marks that were printed by that nozzle deviate consistently (or occasionally) from a standard that is determined from analysis of other test marks, or from independent standards or requirements. For example, a test mark may have a location or appearance that is not consistent with predetermined criteria (e.g. printed too far from center line or too far or too close to fiducial line, too heavy or too light).

If the calculated degree of variation for one or more marks is acceptable, the corresponding nozzles may be qualified for inclusion in the group of selected nozzles (step 54).

The invention claimed is:

1. A method of selecting nozzles for printing a multi-layered line of metallic material, the method comprising:

printing a first plurality of test marks using a plurality of nozzles and according to a set of parameters; printing a second plurality of test marks using the plurality of nozzles and according to the set of parameters;

inspecting the first and second pluralities of test marks to determine whether test marks printed by a particular nozzle of the plurality nozzles are identical in appearance; identifying a set of test marks from the first and second pluralities of test marks that were printed by a particular nozzle and that are not identical in appearance;

identifying the nozzle that printed the identified set of test marks; excluding the identified nozzle from the plurality of nozzles to generate a set of conforming nozzles; and using the set of conforming nozzles to print the multi-layered line of metallic material, wherein each nozzle in the set of conforming nozzles deposits metallic material to form a metallic layer within the multi-layered line of metallic material.

2. The method of claim 1, wherein the first and second pluralities of test marks are printed on a background; and wherein inspecting the first and second pluralities of test marks comprises acquiring an image of the background and each of the first and second pluralities of test marks; and inspecting the acquired image.

3. The method of claim 2, further comprising using the image to calculate optical heaviness, wherein the optical heaviness characterizes how grey each of the first and second plurality of test marks appears relative to a background.

4. The method of claim 1, further comprising calculating one or more values that at least partially characterize each of the first and second pluralities of test marks.

5. The method of claim 4, wherein the one or more calculated values include position, orientation, length, width, or thickness.

6. The method of claim 4, wherein the one or more calculated values include at least one of: length, width, thickness, and position.

7. The method of claim 1, further comprising inspecting the first and second pluralities of test marks to determine whether test marks printed by a particular nozzle conform to a predetermined criterion defining a nominal test mark position.

8. The method of claim 1, further comprising inspecting the first and second pluralities of test marks to determine whether test marks printed by a particular nozzle vary in quality.

9. The method of claim 1, wherein the first and second pluralities of test marks are printed on an erasable reusable substrate.

10. The method of claim 9, wherein the substrate has a glass or ceramic surface.

11. The method of claim 9, further comprising erasing the substrate using mechanical abrasion, rubbing, or scrapping.

12. The method of claim 1, further comprising:

evaluating stability of the plurality of nozzles by comparing test marks repeatedly printed by particular nozzles at different times, wherein the set of conforming nozzles includes nozzles that conform to a predetermined stability criteria.

13. The method of claim 1, wherein the set of conforming nozzles consistently deposit a repeatable amount of the metallic printing fluid.

14. The method of claim 1, further comprising:

assigning a score to each nozzle in the set of conforming nozzles, wherein the score is based on a relative importance of various properties of the test marks with respect to a particular printing application; and using nozzles with higher scores when the particular printing application requires fewer nozzles than are present in the set of conforming nozzles.

15. A method of selecting nozzles for printing a multi-layered line of metallic material, the method comprising:

printing a first plurality of test marks using a plurality of nozzles and according to a set of parameters; printing a second plurality of test marks using the plurality of nozzles and according to the set of parameters;

inspecting individual test marks of the first and second pluralities of test marks to determine whether test marks printed by a particular nozzle are identical in appearance;

assigning each of the plurality of nozzles a value representing an ability of each of the plurality of nozzles to print test marks that are identical in appearance;

using the assigned values to identify a set of nozzles to be excluded from the plurality of nozzles;

excluding the identified set of nozzles to generate a set of conforming nozzles; and using the set of conforming nozzles to print the multi-layered line of metallic material, wherein each nozzle in the set of conforming nozzles deposits metallic material to form a metallic layer within the multi-layered line of metallic material.

16. The method of claim 15, further comprising: repeatedly evaluating the ability of each of the plurality of nozzles to print metallic fluid test marks that are identical in appearance.

17. The method of claim 15, further comprising:

repeatedly evaluating the ability of each of the plurality of nozzles to print metallic fluid test marks that are identical in appearance and ranking the nozzles according to ability.

18. The method of claim 15, wherein the first and second pluralities of test marks are printed on an erasable substrate, the erasable substrate having a glass or ceramic surface and resembling a silicon wafer.

19. The method of claim 15, further comprising: calculating a position of each of the first and second pluralities of test marks.

* * * * *